United States Patent [19]

Larrivee et al.

[11] Patent Number: 4,965,979

[45] Date of Patent: Oct. 30, 1990

[54] CONCRETE BLOCK WALL

[76] Inventors: Ronald J. Larrivee, 1762 Pound Hill Rd.; John D. Downs, Overlea Rd., R.F.D. #2, both of North Smithfield, R.I. 02895

[21] Appl. No.: 352,138

[22] Filed: May 15, 1989

[51] Int. Cl.[5] ..... E04C 1/08; E04C 1/10

[52] U.S. Cl. ..... 52/585; 52/606; 52/608; 405/284

[58] Field of Search ..... 52/594, 606, 608, 593, 52/585; 405/284; 403/292, 298, 374, 409.1

[56] References Cited

U.S. PATENT DOCUMENTS

| | | | |
|---|---|---|---|
| 1,630,698 | 5/1927 | Florey | 52/606 X |
| 2,911,818 | 11/1959 | Smith | 52/606 |
| 3,605,322 | 4/1969 | Matsubayshi | 52/594 X |

FOREIGN PATENT DOCUMENTS

| | | | |
|---|---|---|---|
| 528025 | 4/1954 | Belgium | 52/594 |
| 542360 | 11/1957 | Belgium | 52/594 |
| 2753086 | 6/1978 | Fed. Rep. of Germany | 52/594 |

*Primary Examiner*—David A. Scherbel
*Assistant Examiner*—Jerrold D. Johnson
*Attorney, Agent, or Firm*—Barlow & Barlow, Ltd.

[57] ABSTRACT

A concrete block wall that has blocks with arcuate faces that are laid in alternating courses to form a woven effect. The blocks are laid without mortar and held together by a combination of recesses and protrusions in the upper and lower faces thereof along with a locking piece that engages the radiused end walls of adjacent blocks.

2 Claims, 1 Drawing Sheet

CONCRETE BLOCK WALL

BACKGROUND OF THE INVENTION

It has been well known to utilize brick cinder block and other similar materials to construct walls and it is conventional to erect a wall in courses in which the bricks or blocks in each row are spaced apart and those in the course above and below bridge the space or gap between the bricks or blocks. Most constructions such as this, utilize mortar between the joints and between the courses and depend on rigidity by the utilization of such mortar. It has also been proposed to produce walls by utilizing blocks without the use of any mortar. To this end, it has been proposed to form the blocks with protrusions and recesses as seen in the Rice patent, No. 2,826,906, and a number of forerunners, thereof, such as the Florey patent, No. 1,630,698, and Davies, No. 1,870,102. It has also been proposed to pin the blocks together and constructions of this nature are seen in Frve, No. 3,265,364, and Wilson, No. 3,759,003.

SUMMARY OF THE INVENTION

A concrete block wall which creates a woven basket effect is essentially made out of a plurality of blocks that have an arcuate face and which have a central opening. Each block has a planar upper and lower surface with radius ends and on the upper and lower surfaces are found interlocking members in the form of recesses and protrusions which aid in maintaining the blocks as a wall unit. Essentially, the individual block construction allows one to erect a wall without mortar which is further enhanced by the provision of an interlocking member that is inserted within the opening in the central portion of the block that assists in locking the ends of the blocks together in linear fashion in each course.

DESCRIPTION OF THE PREFERRED EMBODIMENT

Figure 1:
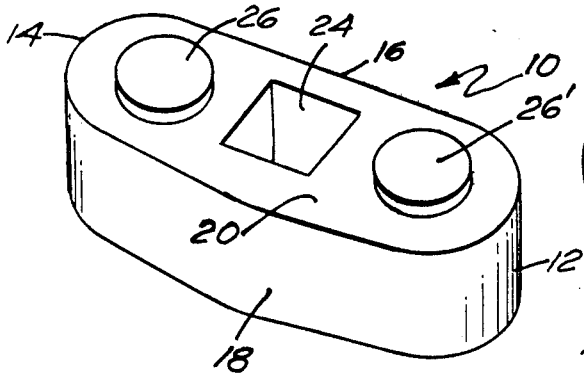
FIG. 1 is a perspective view of one of the blocks used in the wall of the invention.

The building block element 10, as shown in FIG. 1, is preferably cast from a cementitious material and has rounded ends 12 and 14, a substantially flat back wall 16 and a curved front wall 18. The block is also defined by substantially planar upper surface 20 and lower surface 22 and has a central aperture 24 that extends from the upper surface 20 to the lower surface 22.

Figure 3:
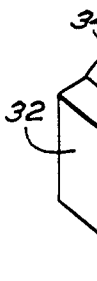
FIG. 3 perspective view of the interlocking member.
Figure 4:
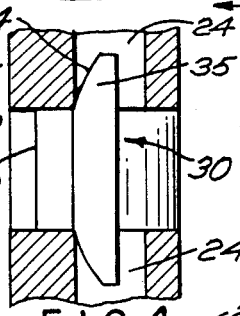
FIG. 4 a sectional view taken on lines 5—5 of FIG. 2.
Figure 5:
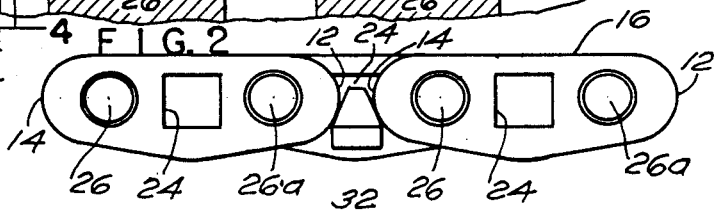
FIG. 5 is a top view of a portion of a wall.
Figure 6:
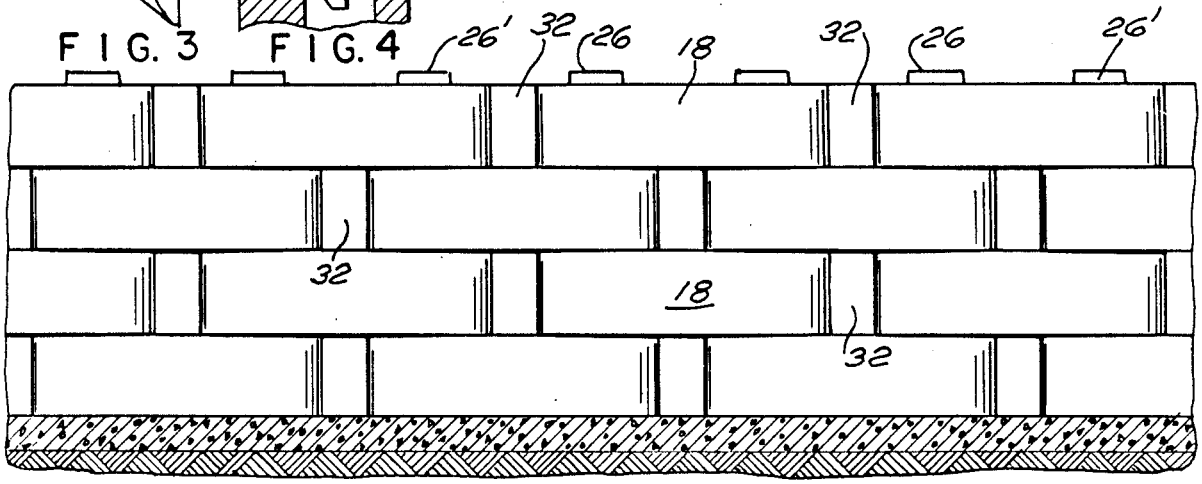
FIG. 6 is an elevational view of a completed wall structure.

The block is also preferably made with two upstanding bosses 26, 26' that protrude from the upper surface 20 and on the lower surface 22, there are corresponding and oppositely disposed sockets or depressions 28, 28'. The bosses and depressions will assist erecting the wall in a uniform pattern and when the blocks are laid in courses, as seen in FIG. 3, they will enable a uniform space between the ends of the blocks to be created so that in the lower course, the aperture 24 will remain essentially exposed. In order to finish the wall structure, an interlocking member 30 is provided and this member essentially has a front face portion 32 of rectangular block form which has a vertical dimension the same as the vertical dimension of the block 10 and has a rearwardly projecting portion 34 which, as seen in FIG. 4, is slightly inclined or tapered and partially convex so as to have a face such as a face 35 that will engage an arcuate end wall such as 12 or 14, as the case might be.

As it will be appreciated from the description as far as it has proceeded, a wall for retaining purposes may be readily erected without mortar, it being merely necessary to place the blocks in the pattern as desired, interlock them with the boss and depression portions and finishing the wall with the interlocking members 30. It will also be apparent that the wall itself may be made arcuate and may even lend itself to a right angular bend by the utilization of the interlocking boss and recess feature.

Figure 7:
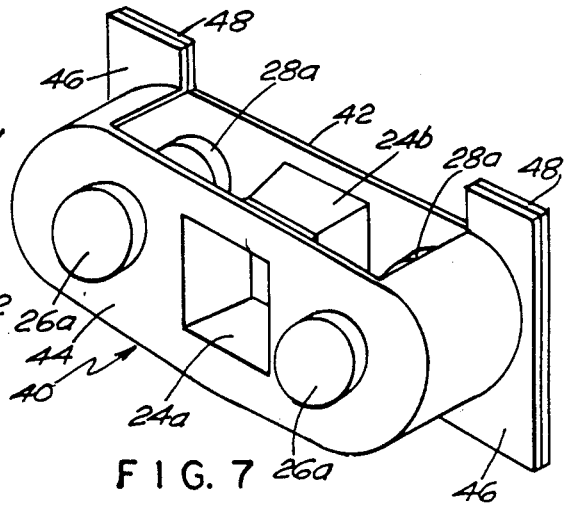
FIG. 7 is a perspective view of a mold for the block.
Figure 2:
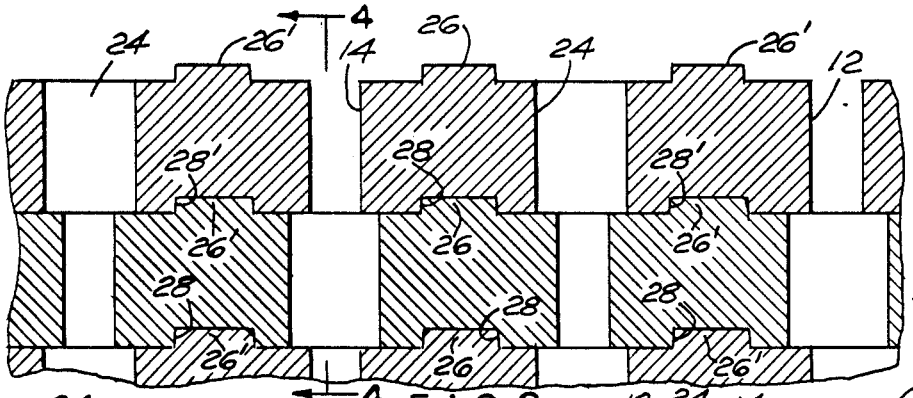
FIG. 2 is a partial central sectional elevational view illustrating two courses.

By referring to FIG. 7, the preferred method of constructing the blocks is illustrated. A two faced mold is provided made up of a first part 40 and a second part 42. Part 40 has a cup shaped portion 44 with depressions **26*a* therein and a large boss 24*a*. As will be noted the cup shaped portion has flanges 46 that extend therefrom and one side is open to permit the pouring of concrete material or the like. The part 42 is essentially a flat wall with protrusions 28*a* and 24*b*. It also has flanges 48 that are provided to engage the flanges 46. When the two parts are in molding position as illustrated, and the flanges are clamped together, the two protrusions 24*a* and 24*b* will engage and the result is a complete void 24** in the completed block as the molding material does not have any opportunity to form a web.

We claim:

1. A concrete block wall creating a woven effect comprising a plurality of blocks having an arcuate face each with planar upper and lower surfaces, radiused ends and a central opening and laid in superimposed courses; the blocks in each course being laid end to end; the blocks in the adjacent course having the radiused ends overlying a portion of the adjacent course and a plurality of interlocking members, each member having a frontal portion and a rear portion, said rear portion engaging the said openings in adjacent courses and the frontal portion engaging the radiused ends of juxtaposed blocks in the same course.

2. A concrete block wall as in claim 1 wherein each member has a rectangular block frontal portion and a tapered elongated rear portion.

* * * * *